US007096962B2

(12) United States Patent
McGarian et al.

(10) Patent No.: US 7,096,962 B2
(45) Date of Patent: Aug. 29, 2006

(54) WELLBORE RECOVERY OPERATION

(75) Inventors: Bruce McGarian, Aberdeen (GB); Ian Alexander Gillies, Angus (GB); Brian Cruickshank, Laurencekirk (GB)

(73) Assignee: Smith International, Inc., Houston, TX (US)

( * ) Notice: Subject to any disclaimer, the term of this patent is extended or adjusted under 35 U.S.C. 154(b) by 168 days.

(21) Appl. No.: 10/491,826

(22) PCT Filed: Oct. 1, 2002

(86) PCT No.: PCT/GB02/04423

§ 371 (c)(1),
(2), (4) Date: Apr. 6, 2004

(87) PCT Pub. No.: WO03/031767

PCT Pub. Date: Apr. 17, 2003

(65) Prior Publication Data

US 2004/0238171 A1 Dec. 2, 2004

(30) Foreign Application Priority Data

Oct. 9, 2001 (GB) ..... 0124221.3

(51) Int. Cl.
*E21B 29/06* (2006.01)

(52) U.S. Cl. ..... 166/381; 166/117.6; 175/57; 175/320

(58) Field of Classification Search ..... 166/117.5, 166/117.6, 381; 175/57, 320
See application file for complete search history.

(56) References Cited

U.S. PATENT DOCUMENTS

| | | | | |
|---|---|---|---|---|
| 2,558,227 | A | 6/1951 | Yancey et al. | |
| 2,797,894 | A | 7/1957 | Meyer | |
| 2,807,440 | A | 9/1957 | Beck | |
| 3,381,979 | A | 5/1968 | Dudman | |
| 3,908,759 | A * | 9/1975 | Cagle et al. | 166/117.6 |
| 4,728,124 | A * | 3/1988 | Righi et al. | 175/320 |
| 4,928,767 | A | 5/1990 | Jelsma | |
| 5,839,519 | A * | 11/1998 | Spedale, Jr. | 175/57 |
| 5,884,698 | A * | 3/1999 | Hughes et al. | 166/117.6 |
| 6,092,601 | A | 7/2000 | Gano et al. | |
| 6,186,249 | B1 * | 2/2001 | Bjornstad | 175/320 |

* cited by examiner

*Primary Examiner*—David Bagnell
*Assistant Examiner*—Matthew J. Smith
(74) *Attorney, Agent, or Firm*—Dykema Gossett PLLC

(57) ABSTRACT

The present invention relates to methods and equipment for recovering use of a well-bore in circumstances where the well bore has become blocked by downhole equipment. The invention provides a method comprising the steps of separating, at a release joint, a portion of equipment from a jammed portion (6) of equipment; running the separated portion of equipment uphole out of the wellbore (100); running a deflector assembly (60) downhole into the wellbore (100); and deflecting a milling tool (64) from the wellbore into surrounding formation. The method is characterised by restricting relative movement between the deflector assembly (60) and the wellbore (100) by engaging, prior to deflecting the milling tool (64), the deflector assembly (60) with said jammed portion (6) of equipment.

10 Claims, 4 Drawing Sheets

WELLBORE RECOVERY OPERATION

The present invention relates to methods and equipment for recovering use of a wellbore in circumstances where the wellbore has become blocked by downhole equipment.

It is not uncommon for a drill bit to become stuck inhole during downhole oil and gas drilling operations. In order to allow retrieval of a downhole drill string when a drill bit becomes jammed, it is known to provide a drill string with an emergency release joint immediately uphole of the drill bit. During normal operation, the release joint (commonly referred to as a shear sub) transmits torque from a motor to the drill bit. However, in the event that the drill bit becomes jammed to the extent that axial and rotational movement of the drill bit is not possible, the drill bit may be separated from the remainder of the drill string by virtue of the release joint. The remainder of the drill string may then be moved axially uphole so that specialist retrieving equipment may be run to the drill bit in a fishing operation. The retrieving equipment engages suitable means provided on the portion of release joint attached to the drill bit and is then manipulated so that the drill bit is subjected to releasing forces. Once the drill bit has been released from the wellbore, the retrieving equipment may be moved uphole, together with the drill bit, so as to reopen the wellbore for subsequent downhole operations.

Although the aforementioned method of reclaiming use of a wellbore is generally effective, there remains the possibility that the drill bit cannot be conveniently released from the wellbore and that, as a consequence, subsequent use of the wellbore is constrained. In these circumstances, the drill bit must be either destroyed or a whipstock/deflector and anchor packer must be run inhole and set above the drill bit so that a branch borehole may be cut to bypass the blocked portion of primary borehole. With reference to the second of these options, it will be understood that there are adverse cost implications in requiring the use of additional downhole equipment.

Prior art document U.S. Pat. No. 2,797,894 discloses a method of reclaiming use of a wellbore wherein a deflector is screw threadedly engaged with equipment stuck downhole. However, orientation of the deflector within the wellbore is determined by the orientation of the stuck equipment and this can lead to problems when drilling a branch borehole bypassing the blocked portion of primary borehole.

A first aspect of the present invention provides a method of recovering use of a downhole wellbore which has become blocked by downhole equipment jammed in the wellbore; wherein the downhole equipment comprises a release joint for permitting separation of a portion of said equipment, which is jammed within the wellbore, from the remainder of said equipment; the method comprising the steps of separating, at the release joint, the remainder of said equipment from said jammed portion of equipment; running the remainder of said equipment uphole out of the wellbore; running a deflector assembly downhole into the wellbore; restricting relative movement between the deflector assembly and the wellbore by engaging the deflector assembly with said jammed portion of equipment so as to substantially prevent relative rotation between said jammed portion and a first portion of deflector assembly engaged therewith; and then deflecting a milling tool from the wellbore into surrounding formation by means of the deflector assembly so as to form a branch borehole; the method comprising the characterising step of engaging the deflector assembly with said jammed portion by means of co-operating splines provided on the deflector assembly and said jammed portion; the deflector assembly being rotationally orientated, into an angular position required when deflecting the milling tool, prior to the deflector assembly being engaged with said jammed portion.

A second aspect of the present invention provides a method of recovering use of a downhole wellbore which has become blocked by downhole equipment jammed in the wellbore; wherein the downhole equipment comprises a release joint for permitting separation of a portion of said equipment, which is jammed within the wellbore, from the remainder of said equipment; the method comprising the steps of separating, at the release joint, the remainder of said equipment from said jammed portion of equipment; running the remainder of said equipment uphole out of the wellbore; running a deflector assembly downhole into the wellbore; restricting relative movement between the deflector assembly and the wellbore by engaging the deflector assembly with said jammed portion of equipment so as to substantially prevent relative rotation between said jammed portion and a first portion of deflector assembly engaged therewith; and deflecting a milling tool from the wellbore into surrounding formation by means of the deflector assembly so as to form a branch borehole; the method comprising the characterising step of rotationally orientating a second portion of deflector assembly into an angular position required when deflecting the milling tool, wherein said orientating step is undertaken following the step of engaging the deflector assembly with said jammed portion.

Thus, in a method according to the present invention, once downhole equipment (such as a drill bit) becomes jammed within a wellbore, a release joint may be employed in a conventional manner to separate the jammed portion of equipment from the remainder portion of equipment so that said remainder portion may be run uphole out of the wellbore. However, rather than then running and setting an anchor packer within the wellbore, the method of the present invention provides for the running of a whipstock/deflector assembly per se and the engagement of this assembly with said jammed portion of equipment. In this way, it is possible to locate the deflector assembly at a desired depth within the wellbore and at a required angular orientation without the need for an anchor packer. The deflector assembly may then be used to deflect a milling tool into surrounding formation so that the blocked portion of primary borehole may be bypassed. The branch borehole may be milled so as to rejoin the primary borehole downhole of the blocked portion. During the milling operation, reaction forces on the deflecting assembly are transmitted to the wellbore wall by means of the jammed portion of equipment. In this way, the position of the deflector assembly is maintained whilst the branch borehole is milled.

Through use of the aforementioned method of the present invention, it will be clear that use of an anchor packer is advantageously not required.

When, following the step of engaging the deflector assembly with said jammed portion, a second portion of deflector assembly is rotationally orientated, said second portion of deflector assembly may be rotationally orientated relative to said first portion of deflector assembly by means of a swivel sub comprised in the deflector assembly. It is also preferable for said swivel sub to be hydraulically actuated and the aforesaid step of rotationally orientating said first portion of deflector assembly relative to said second portion of deflector assembly to comprise the step of varying fluid pressure within said swivel sub. Also, the deflector assembly may be engaged with said jammed portion by means of co-operating splines provided on the deflector assembly and said jammed portion. Alternatively, the deflector assembly may be engaged with said jammed portion by means of co-operating screw threads provided on the deflector assembly and said jammed portion.

Furthermore, the step of restricting relative movement between the deflector assembly and the wellbore may comprise the step of engaging the deflector assembly with said jammed portion so as to permit transmission of an axial force from the deflector assembly to said jammed portion which acts in an uphole direction on said jammed portion.

A further aspect of the present invention provides a method of recovering use of a downhole wellbore which has become blocked by downhole equipment jammed in the wellbore; wherein the downhole equipment comprises a release joint for permitting separation of a portion of said equipment, which is jammed within the wellbore, from the remainder of said equipment; the method comprising the step of separating, at the release joint, the remainder of said equipment from said jammed portion of equipment; running the remainder of said equipment uphole out of the wellbore; and running a deflector assembly downhole into the wellbore; the method comprising the characterising steps of engaging the deflector assembly with said jammed portion of equipment; transmitting a force from the deflector assembly to said jammed portion of equipment so as to release said portion from the wellbore; and running said portion and the deflector assembly uphole out of the wellbore.

Thus, in a method according to the further aspect of the present invention, once the deflector assembly is engaged with said jammed portion of equipment, the deflector assembly is manipulated so as to transmit forces to said jammed portion in an attempt to free said jammed portion from the wellbore. If said jammed portion is released from the wellbore, then it may be run uphole so as to reopen the borehole. However, if said jammed portion is not released, then the deflector assembly may be used to mill a branch borehole in accordance with the first aspect of the present invention.

A yet further aspect of the present invention provides a drill bit comprising a first portion provided with cutting elements and a second portion provided with cutting elements, the first and second portions being releasably connected to one another. Preferably, said first and second portions are releasably connected to one another by means of one or more shear pins. The first and second portions may also be engaged with one another by means of splines.

A still further aspect of the present invention provides downhole apparatus comprising a first part connected to a second part by connecting means, the connecting means limiting axial and rotational movement of the first part relative to the second part and comprising a frangible member for allowing selective separation of the first part from the second part, wherein at least one of the first and second parts is provided with cutting elements.

Another aspect of the present invention provides a method of using the aforementioned apparatus wherein a part of said apparatus provided with cutting elements is connected to a drill bit.

Embodiments of the present invention will now be described with reference to the accompanying drawings.

DETAILED DESCRIPTION OF THE PREFERRED EMBODIMENT

Figure 1:
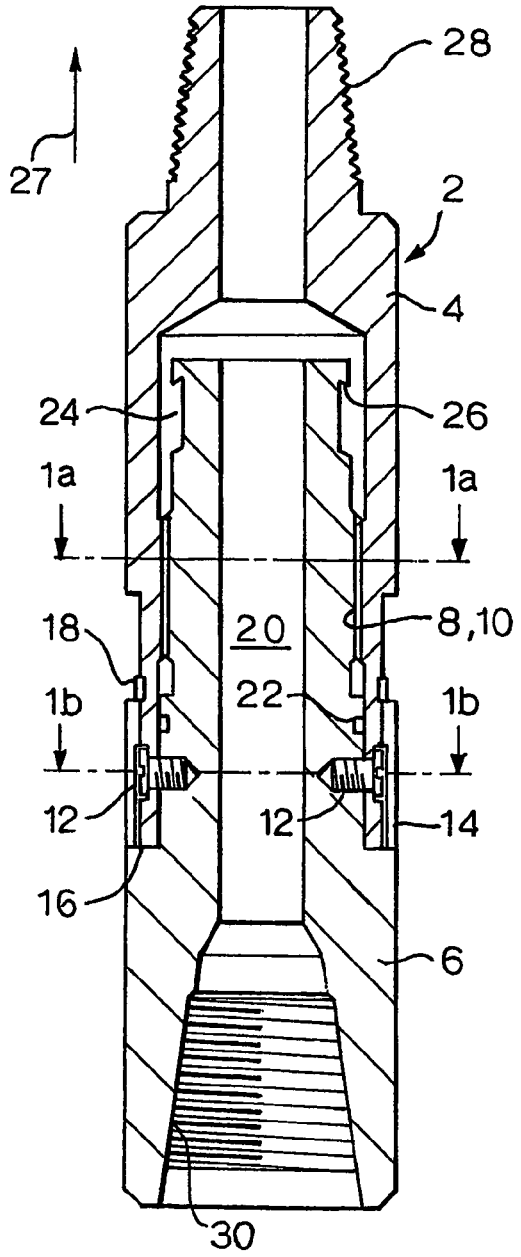
FIG. 1 is a cross-sectional side view of a shear sub having an internal latch fishing neck.
Figure 1A:
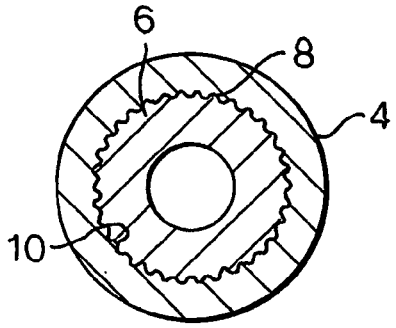
FIG. 1*a* is a cross-sectional view taken along line 1*a*—1*a* shown in FIG. 1.
Figure 1B:
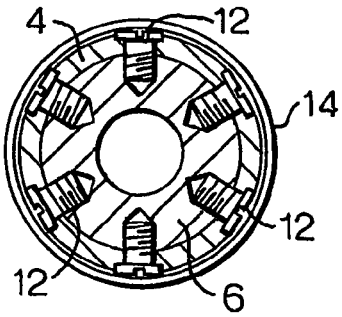
FIG. 1*b* is a cross-sectional view taken along line 1*b*—1*b* shown in FIG. 1.

A first shear sub 2 is shown in FIGS. 1, 1*a* and 1*b* of the accompanying drawings. The first shear sub 2 comprises two principle components, namely an upper portion 4 and a lower portion 6, which are interconnected with one another by means of a plurality of inter-engaging splines 8,10 (see FIG. 1*a*) and a plurality of shear pins 12 (see FIG. 1*b*). With reference to FIG. 1*a*, it will be seen that the upper portion 4 is provided with a number of splines 10 which inter-engage with a number of splines 8 provided on the lower portion 6. This inter-engagement of splines 8, 10 allows rotary forces to be transmitted between the upper and lower portions 4,6 of the shear sub 2. The plurality of shear pins 12 allow a transmission of axial force between the upper and lower portions 4,6. Although the first shear sub 2 is provided with six shear pins 12, any number of shear pins may be provided. It will be understood from FIGS. 1, 1*a* and 1*b* that the upper and lower portions 4,6 have a generally cylindrical shape and that an upper end of the lower portion 6 is received within a lower end of the upper portion 4. Each shear pin 12 extends through an aperture provided in the lower end of the upper portion 4 and locates within a recess defined in the upper end of the lower portion 6. In this way, the plurality of shear pins 12 restrict relative axial movement between the upper and lower portions 4,6.

A sleeve 14 having a generally cylindrical shape is located about the lower end of the upper portion 4 so as to cover and protect the shear pins 12. The sleeve 14 is retained adjacent an upwardly facing external shoulder 16 provided on the lower portion 6. The sleeve 14 is retained by means of a circlip 18 located in an external groove provided in the lower end of the upper portion 4. The circlip 18 and shoulder 16 are located at upper and lower ends respectively of the sleeve 14 and thereby prevent axial movement of the sleeve 14 relative to the upper and lower portions 4,6.

A bore 20 extends through the upper and lower portions 4,6 so as to allow fluid communication through the shear sub 2. A seal 22 located between the upper and lower portions 4,6 serves to prevent the ingress of wellbore fluid into the bore 20 from a location exterior to the shear sub 2.

The exterior surface of the upper end of the lower portion 6 is provided with a circumferential recess 24. This recess 24 provides means by which a fishing tool (or other downhole equipment) may become latched to the lower portion 6 once the upper portion 4 has been removed therefrom. The recess 24 defines a downwardly facing external shoulder 26 which (once the upper portion 4 has been removed from the lower portion 6) can be engaged by a fishing tool (or other downhole equipment) so as to allow an upward force (acting in the direction shown by arrow 27 to be applied to the lower portion 6.

The shear sub 2 is provided with external screw threads 28 located at the upper end of the upper portion 4 and internal screw threads 30 located at the lower end of the lower portion 6 for attachment of the shear sub to downhole equipment. For example, the lower portion 6 will be typically connected to a drill bit by means of the internal screw threads 30 whilst the upper portion 4 will be connected to a drill string by means of external screw threads 28.

Figure 2:
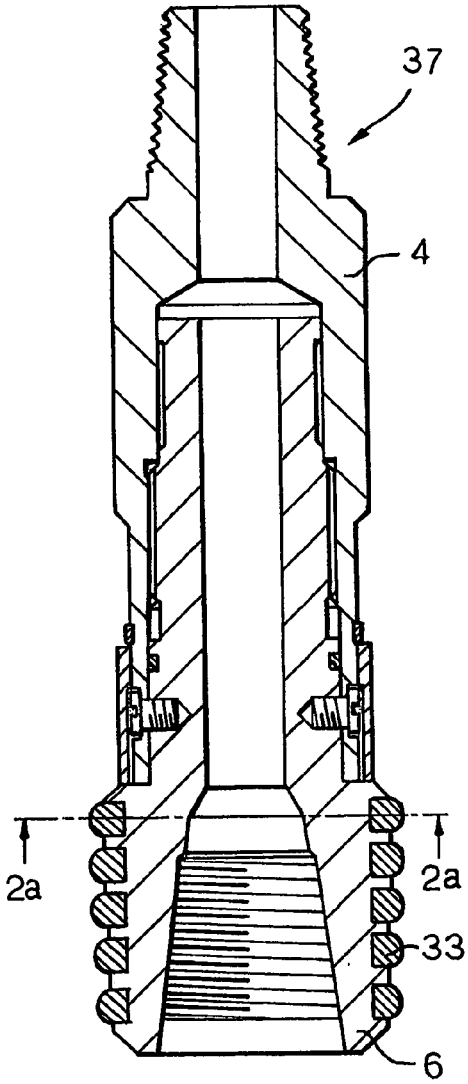
FIG. 2 is a cross-sectional side view of a shear sub having reaming elements located on a lower portion thereof.
Figure 3:
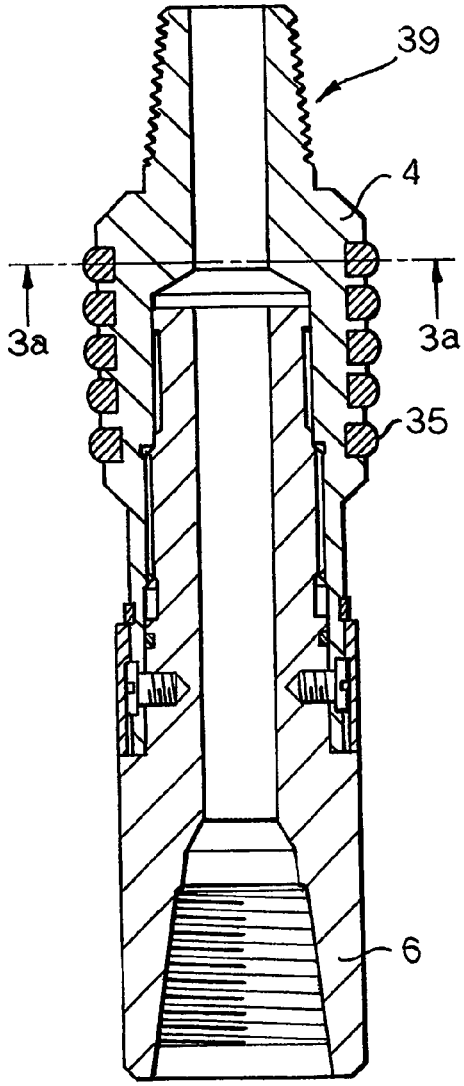
FIG. 3 is a cross-sectional side view of a shear sub having reaming elements located on an upper portion thereof.
Figure 2A:
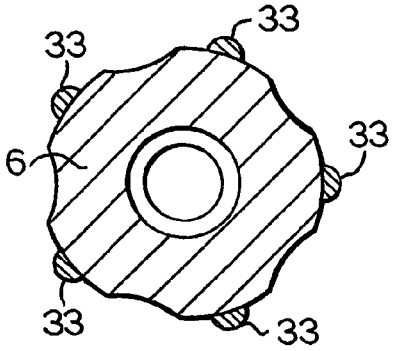
FIG. 2*a* is a cross-sectional view taken along line 2*a*—2*a* shown in FIG. 2.
Figure 3A:
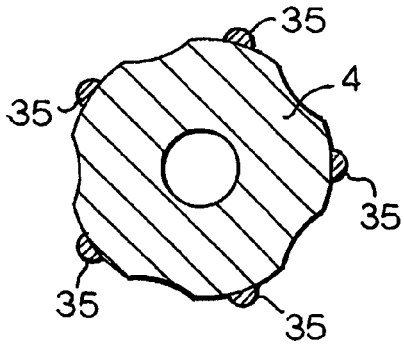
FIG. 3*a* is a cross-sectional view taken along line 3*a*—3*a* shown in FIG. 3.

The shear sub 2 may be modified in a number of ways. For example, the exterior surfaces of the upper and lower portions 4, 6 may be provided with cutting elements. These elements may be used to ream a borehole. Two modified shear subs 37, 39 are shown in FIGS. 2 and 3 respectively. Each of these modified shear subs 37, 39 is substantially identical to the shear sub 2 shown in FIG. 1 other than for the provision of cutting elements. With regard to the first modified shear sub shown in FIG. 2, a plurality of cutting elements 33 are embedded in that area of exterior surface of the lower portion 6 located below the upper portion 4. With regard to the second modified shear sub shown in FIG. 3, a plurality of cutting elements 35 are embedded in an area of the exterior surface of the upper portion 4. In each of the two modified shear subs 37, 39 the area of lower or upper portion divided with cutting elements has an expanded outer diameter relative to that of the shear sub 2 shown in FIG. 1.

Alternative means for engaging a fishing tool (or other downhole equipment) may also be provided. For example, the upper end of the lower portion 6 may be provided with either an internal or external screw thread. In this regard, FIG. 4 of the accompanying drawings shows a further shear sub 40 which differs from the first shear sub 2 only in that the fishing tool engagement means 24,26 of the first shear sub 2 is replaced by alternative engagement means in the form of internal screw threads 42 defined in the upper part of bore provided in the lower portion 6.

During use of the shear sub in a drilling operation, torque is transmitted from the drill string to the drill bit by means of the plurality of splines 8, 10. If the drill bit becomes jammed within the weilbore, then an attempt at releasing the drill bit may be made by applying axial force. Axial force in a downhole direction (i.e. opposite to that indicated by arrow 27) is transmitted through the shear sub by the abutment of the upper portion 4 with the shoulder 16 of the lower portion 6. Axial force acting in an uphole direction (as indicated by arrow 27) is transmitted through the shear sub by the plurality of shear pins 12. However, in the event that the drill bit cannot be released from the wellbore, uphole axial force may be increased to such an extent that the plurality of shear pills 12 shears, allowing the upper portion 4 to move axially uphole relative to the lower portion 6. The upper portion 4 of the shear sub 2, 40 may then be run uphole out of the wellbore together with the drill string attached thereto. In removing the upper portion 4, the engaging means 24,26,42 of the lower portion 6 is exposed.

Figure 5:
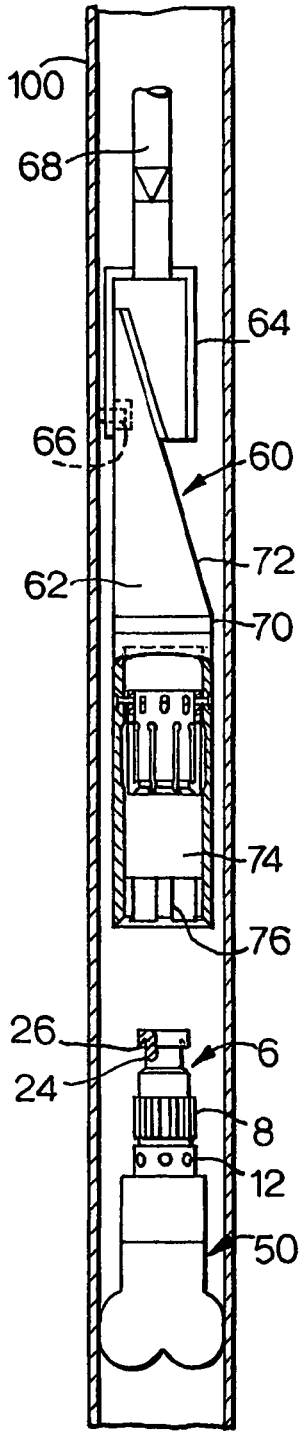
FIG. 5 is a schematic side view of a jammed portion of downhole equipment and a deflector assembly for engagement therewith located within a wellbore.

A schematic side view of a drill bit 50 jammed within a wellbore 100 is shown in FIG. 5 of the accompanying drawings. In an attempt to recover use of the wellbore 100, FIG. 5 illustrates the running downhole of a single trip whipstock assembly subsequent to the aforementioned removal of the upper portion 4 of a shear sub and associated drill string. The whipstock/deflector assembly 60 is made up of a deflector 62 and a milling tool 64 secured to an uphole end of the deflector 62 by means of release means 66 (such as a shear pin). The deflector 62 has a surface 72 for deflecting the milling tool 64 into surrounding formation. The deflector assembly 60 is run downhole by means of a conveying string 68 which may be coil tubing or a wireline. The deflector assembly 60 also comprises a swivel sub 70 located between the deflecting surface 72 and means for engaging the lower portion 6 (see below). The swivel sub may be actuated either mechanically or hydraulically so as to allow rotation of the deflecting surface 72 relative to said engaging means of the assembly 60. In this way, the deflecting surface 72 may be rotated to a required angular orientation once the assembly 60 is engaged with the lower portion 6. Both hydraulically actuated swivel subs and mechanically actuated swivel subs are well known in the art and involve the disengagement of internal splines so as to allow relative rotation of component parts before a subsequent re-engagement of said splines to lock said parts in a required angular orientation. The position of the deflecting surface 72 may be monitored through use of Measure-While-Drilling (MWD) equipment.

As can be seen from FIG. 5, the downhole end of the deflector 62 is provided with engaging means for limiting axial and rotational movement between the lower portion 6 and the deflector assembly 60. The form of said means depends upon the type of fishing tool engaging means 24,26,42 provided on the lower portion 6. In circumstances where the lower portion 6 is provided with a screw thread (whether internal or external), the lower end of the deflector assembly 60 is provided with a co-operating screw thread with such fishing tool engaging means, it is highly desirable for a swivel sub to be located between the co-operating screw thread and the remainder of the deflector assembly 60 (a previously mentioned) so as to allow rotation of the mill deflecting surface 72 to a required angular orientation once the deflector assembly 60 and lower portion 6 have been screw-threadedly engaged with one another. It will be understood that the co-operating screw threads of the lower portion 6 and deflector assembly 60 limit both relative axial and rotational movement thereof.

The provision of a swivel sub is generally not necessary when the deflector assembly is engaged with the lower portion 6 by means of splines. This is because the splines allow a predetermined orientation of deflector assembly relative to lower portion 6 to be fixed when the deflector assembly and lower portion are pressed axially together (provided the splines have a fine arrangement allowing a large number of small variations in relative angular position).

In the arrangement of FIG. 5, the lower portion 6 is shown as described in relation to the first shear sub 2. Accordingly, the engaging means of the deflector assembly 60 comprises a bore 74 in which the lower portion 6 is received. The lower end of the bore 74 is provided with a plurality of splines 76 which co-operate with the plurality of splines 8 provided on the lower portion 6. This co-operation of splines allows relative axial movement of the lower portion 6 and deflector assembly 60 whilst limiting relative rotational movement thereof. Relative axial movement between the lower portion 6 and the deflector assembly 60 is limited by means of engagement of the shoulder 26 of the lower portion 6 with a plurality of collet tabs 80 located within the deflector bore 74 (see FIG. 6).

Figure 6:
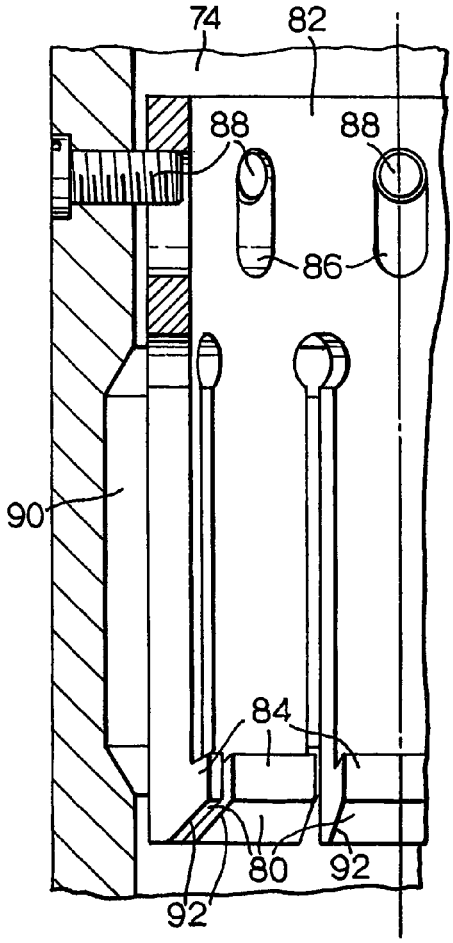
FIG. 6 is a partial cross-sectional side view of a latch engaging mechanism of the deflector assembly shown in FIG. 3.

With reference to FIG. 6, it will be seen that the bore 74 of the deflector assembly 60 houses a cylindrical member 82. The lower end of the cylindrical member 82 defines the aforementioned plurality of collet tabs 80. The lower end of each collet tab 80 is provided with an inwardly radially extending portion 84 defining an upwardly facing shoulder for engagement with the downwardly facing shoulder 26 of the lower portion 6. The upper part of the cylindrical member 82 is provided with a plurality of axially extending slots 86 for receiving shear pins 88 fixedly secured to the bore 74. The location of a shear pin 88 in each of the slots 86 allows limited axial movement of the cylindrical member 82 within the bore 74 but substantially prevents relative rotational movement. As can be most clearly seen from FIG. 6, the bore 74 is provided with a portion 90 of increased diameter. With the cylindrical member 82 in its lower-most position within the bore 74 (as shown in FIG. 6), the free ends of the plurality of collet tabs 80 locate downhole of said portion 90 of increased bore diameter. As a result, outward radial movement of the free ends of the collet tabs 80 is substantially prevented. However, as the deflector assembly 60 is run downhole and the lower portion 6 is received within the bore 74, said lower portion 6 abuts an angled camming surface 92 provided on the end of each collet finger 80. As the deflector assembly 60 is pushed down over the lower portion 6, the cylindrical portion 80 is pressed upwardly relative to the bore 74. An outward radial component of force is also generated on the free ends of the collet tabs 80 by virtue of the lower portion 6 acting on the camming surfaces 92. Thus, once the free ends of the collet tabs 80 are pushed into the portion 90 of expanded bore diameter, said collet free ends move radially outwardly. The diameter of the expanded portion 90 of bore is sufficient to allow the radial deflection of the collet free ends required for the shoulder 26 of the lower portion 6 to be received with the cylindrical member 82. Once said shoulder 26 is received within the cylindrical member 82, the free ends of the collet tabs 80 return to their undeformed radial positions as shown in FIG. 6. As a result, subsequent uphole movement of the deflector assembly 60 engages said shoulder 26 with the collet shoulders 84. This engagement allows the cylindrical member 2 to be moved downwardly relative to the bore 74 back into the position shown in FIG. 4. The lower portion 6 thereby becomes latched to the deflector assembly 60.

With the deflector assembly 60 latched to the lower portion 6, an uphole axial force may be applied to the lower portion 6 in an attempt to release said lower portion 6 from the wellbore. If this attempt fails, then the milling tool 64 may be deflected from the deflecting surface 72 into the surrounding formation so as to cut a branch borehole bypassing the lower portion 6. The deflector assembly 60 may be removed from the wellbore by applying an uphole force thereto sufficient to shear the shear pins 88.

Figure 4:
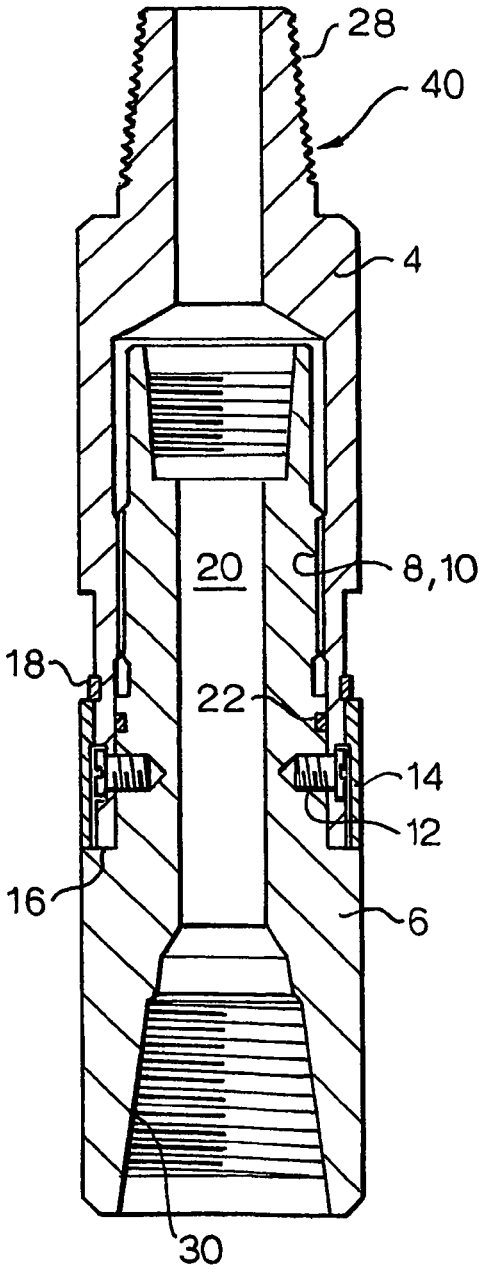
FIG. 4 is a cross-sectional side view of a shear sub having an internal screw threaded fishing neck.
Figure 7:
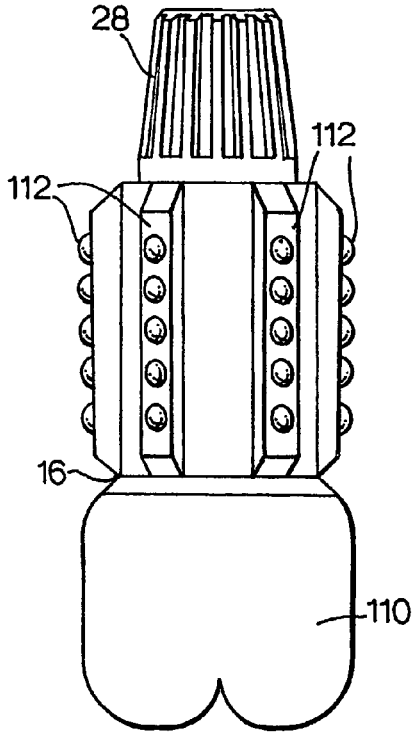
FIG. 7 is a schematic side view of a drill bit comprising an integral shear sub.

In an alternative system, the shear sub and a drill bit may be made integral. Such an assembly, as shown in FIG. 7, may be formed by modifying either of the shear subs 2, 40 of FIGS. 1 and 4 by providing the part of the lower portion 6 located below the upwardly facing shoulder 16 thereof with milling blades 110. Clearly, the internal screw threads 30 of the lower portion 6 are not required and the bore 20 is therefore preferably sealed so as not to open onto the surface provided with the milling blades 110. The external cylindrical surface of the upper portion 4 may be provided with cutting elements 112 (such as diamond or carbide inserts) for performing a reaming function. The internal structure of the element shown in FIG. 7 is as illustrated in FIGS. 1 or 4. The remaining elements 112 may be provided as shown in FIG. 3.

The present invention is not limited to the specific embodiments described above. Alternative arrangements will be apparent to a reader skilled in the art.

The invention claimed is:

1. A method of recovering use of a downhole wellbore which has become unintentionally blocked by downhole equipment that has become jammed in the wellbore, the downhole equipment comprising opposite first and second end portions and a release joint therebetween, said release joint permitting separation of said first end portion when jammed within the wellbore from the second end portion, the method comprising the steps of separating, at the release joint, the second end portion of said equipment from said first, jammed end portion , running the second end portion uphole out of the wellbore, running a deflector assembly downhole into the wellbore, restricting relative movement between the deflector assembly and the wellbore by engaging the deflector assembly with said first end portion of said equipment so as to substantially prevent relative rotation between said first end portion and a first portion of said deflector assembly engaged therewith, and then deflecting a milling tool from the wellbore into surrounding formation by means of the deflector assembly so as to form a branch borehole the deflector assembly engaging said first end portion by means of co-operating splines provided on the deflector assembly and said first end portion, the deflector assembly being rotationally orientated into an angular position required when deflecting a milling tool prior to the deflector assembly being engaged with said first end portion.

2. A method as claimed in claim 1, wherein the step of restricting relative movement between the deflector assembly and the wellbore comprises the step of engaging the deflector assembly with said jammed portion so as to permit transmission of an axial force from the deflector assembly to said jammed portion which acts in an uphole direction on said portion.

3. A method according to claim 1, wherein said downhole equipment is a drill.

4. A method according to claim 1, wherein said downhole equipment is a drill bit.

5. A method of recovering use of a downhole wellbore which has become unintentionally blocked by downhole equipment that has become jammed in the wellbore, the downhole equipment comprising opposite first and second end portions and a release joint therebetween, said release joint permitting separation of said first end portion when jammed within the wellbore from the second end portion, the method comprising the steps of separating, at the release joint, the second end portion of said equipment from said first, jammed end portion, running the second end portion uphole out of the wellbore, running a deflector assembly downhole into the wellbore, restricting relative movement between the deflector assembly and the wellbore by engaging the deflector assembly with said first end portion of said equipment so as to substantially prevent relative rotation between said first end portion and a first portion of said deflector assembly engaged therewith; rotationally orientating a second portion of deflector assembly into an angular position required when deflecting a milling tool, following the step of engaging the deflector assembly with said first end portion, and deflecting a milling tool from the wellbore into surrounding formation by means of the deflector assembly to form a branch borehole.

6. A method as claimed in claim 5, wherein said second portion of deflector assembly is rotationally orientated relative to said first portion of deflector assembly by means of a swivel sub comprised in the deflector assembly.

7. A method as claimed in claim 6, wherein said swivel sub is hydraulically activated and the step of rotationally orientating said first portion of deflector assembly relative to said second portion of deflector assembly comprises the step of varying fluid pressure within said swivel sub.

8. A method as claimed in claim 5, wherein the deflector assembly is engaged with said jammed portion by means of co-operating splines provided on the deflector assembly and said jammed portion.

9. A method according to claim 5, wherein said downhole equipment is a drill.

10. A method according to claim 5, wherein said downhole equipment is a drill bit.

* * * * *